US009248075B2

(12) United States Patent
Spencer et al.

(10) Patent No.: US 9,248,075 B2
(45) Date of Patent: Feb. 2, 2016

(54) LAMINAR JET AND HYDROTHERAPY BATH SYSTEM

(76) Inventors: Michael Spencer, Prescott, AZ (US); Scott A. Smith, Lago Vista, TX (US)

( * ) Notice: Subject to any disclaimer, the term of this patent is extended or adjusted under 35 U.S.C. 154(b) by 2728 days.

(21) Appl. No.: 11/788,083

(22) Filed: Apr. 19, 2007

(65) Prior Publication Data

US 2007/0256231 A1 Nov. 8, 2007

Related U.S. Application Data

(60) Provisional application No. 60/793,397, filed on Apr. 19, 2006.

(51) Int. Cl.
*A47K 3/00* (2006.01)
*A61H 33/00* (2006.01)

(52) U.S. Cl.
CPC ..... *A61H 33/6063* (2013.01)

(58) Field of Classification Search
USPC ..... 4/541.1–541.6, 490, 492, 591; 239/398, 239/428.5, 214, 210, 461, 502, 595, 593, 239/592
See application file for complete search history.

(56) References Cited

U.S. PATENT DOCUMENTS

| | | | | | |
|---|---|---|---|---|---|
| 3,578,023 | A | * | 5/1971 | Diemond et al. | 137/592 |
| 4,340,982 | A | * | 7/1982 | Hart et al. | 4/492 |
| 4,383,340 | A | | 5/1983 | Braun, Jr. | 4/541 |
| 4,514,868 | A | * | 5/1985 | Visinand | 4/541.3 |
| 4,520,514 | A | * | 6/1985 | Johnson | 4/490 |
| 4,896,384 | A | * | 1/1990 | Dijkhuizen | 4/541.6 |
| 4,953,240 | A | | 9/1990 | Gardenier | 4/542 |
| 5,010,605 | A | | 4/1991 | Shiina et al. | 4/542 |
| 5,115,974 | A | * | 5/1992 | Tobias et al. | 239/23 |
| 5,207,729 | A | | 5/1993 | Hatanaka | 4/492 |
| 5,392,472 | A | * | 2/1995 | Maxfield | 4/512 |
| 5,548,854 | A | | 8/1996 | Bloemer et al. | 4/541.6 |
| 5,662,558 | A | | 9/1997 | Shannon, III | 482/55 |
| 5,983,417 | A | * | 11/1999 | Perdreau et al. | 4/541.6 |
| 6,182,303 | B1 | | 2/2001 | Gardenier et al. | 4/541.6 |
| D460,192 | S | | 7/2002 | Collins et al. | D24/204 |
| 6,643,859 | B1 | | 11/2003 | Brennan et al. | 4/541.6 |
| 6,760,932 | B1 | | 7/2004 | Maiuccoro | 4/541.4 |
| 6,859,954 | B2 | | 3/2005 | Collins et al. | 4/541.1 |
| 2005/0155144 | A1 | | 7/2005 | McDonald et al. | 4/507 |
| 2005/0235407 | A1 | | 10/2005 | Kunkel | 4/507 |

* cited by examiner

*Primary Examiner* — Lauren Crane
*Assistant Examiner* — Erin Deery
(74) *Attorney, Agent, or Firm* — Sean D. Senn, Esq.; Archer Norris, PLC

(57) ABSTRACT

A laminar jet for a hydrotherapy tub having a water inlet adapted for attachment to a water circulation system, a flow inducer section and a cap having a water outlet at one end of the cap. The cap may be rotated so the jet directs a substantially laminar water stream from the water outlet substantially parallel to tub surface. The jet cap may be locked in a desired position. A bathtub may have a number of laminar jets which may be direct water streams toward convergent zones and may simulate natural laminar flows. The zones or streams may be associated with recesses, channels or protrusions on a tub wall or directed to or around an object or occupant in the tub. The jet may be optimized for laminar flow by CFD, including streamline adjusting, eliminating negative pressure drop, and maximizing volumetric flow.

21 Claims, 8 Drawing Sheets

EMBODIMENT 8A FROM DOCUMENT

SECTION B-B
SCALE 1 : 1

ORIGINAL DESIGN CONCEPT

EMBODIMENT 8A FROM DOCUMENT

SECTION C-C
SCALE 1 : 1

SECTION A-A
SCALE 1 : 1
section view of final jet design 120
126
132
134
127
136
106
46

FRONT VIEW 132
122
FRONT VIEW

SIDE VIEW

FINAL VERSION
126
124
122
44
42
SIDE VIEW 126
44
TOP VIEW

LAMINAR JET AND HYDROTHERAPY BATH SYSTEM

REFERENCE TO RELATED APPLICATIONS

This application claims priority from U.S. provisional patent application Ser. No. 60/793,397 filed Apr. 19, 2006.

BACKGROUND OF THE INVENTION

The invention relates to a laminar flow water jet for a hydrotherapy bath or spa system and a hydrotherapy bath system with two or more jets providing a converging flow pattern.

It is widely know in the art how to inject water and/or air through orifices, jets or nozzles in just about any given direction. It is known to direct water towards an occupant(s), or a certain body portion of an occupant, in a whirlpool bath. It is known that the occupant's body may alter or block the flow from a jet or possibly cooperate with the jet to produce a desired flow pattern as disclosed for example in U.S. Pat. No. 4,953,240 and U.S. Pat. No. 4,383,340). U.S. Pat. No. 4,383,340 discloses the use of multiple jets to produce more powerful flows. U.S. Pat. No. 5,548,854 discloses sequentially pulsating flows. Thus, it is known to impact multiple body parts simultaneously or sequentially. It is known to direct water parallel to a surface of the tub or a surface of an occupant to extend the area of impact of a jet. Representative of the art is U.S. Pat. No. 6,760,932, U.S. Pat. No. 6,643,859, and U.S. Pat. No. 6,182,303. Turbulent flow is generally presumed, intended, or desired for a massaging effect on the human body. Entrained air is commonly used to increase turbulence.

Laminar flow may be more desirable than turbulence in certain limited situations. For example, a uniform laminar current may be desirable to swim against in a swim training tub or pool as disclosed in U.S. Pat. No. 5,662,558 and U.S. Pat. No. 5,207,729, or to produce Karman vortices for vibratory weight reduction as disclosed in U.S. Pat. No. 5,010,605. Laminar water jets have been used for desirable visual effects in fountain displays as disclosed in U.S. Pat. Publication No. 2005/0235407A1, and/or for waterfall displays for tubs or ponds or pools as disclosed in U.S. Pat. Publication No. 2005/0155144A1. In producing or using laminar flow, various vanes, holes, dividers, and restrictions in various parts of the flow channels and/or the jets have been provided as disclosed for example in U.S. Pat. No. 2005/0155144A1. Also provided are anti-cavitation plates, stabilizing plates or fins and the like as disclosed for example in U.S. Pat. No. 5,662,558 and U.S. Pat. No. 5,207,729.

What is not known or taught in the art is a whirlpool-type, hydrotherapy bath having a combination of laminar jets that produce a soothing, therapeutic laminar flow. What is needed is a laminar flow jet having a streamlined internal shape or design. What is needed is at least two laminar jets directing water streams substantially parallel to a tub wall into a convergent flow zone. What is needed is a tub with laminar jets that produce a flow pattern simulative of a natural river current flow over an occupant's body. What is needed is a parallel flow jet that is rotatable for selection of flow direction. What is needed is tub with structural features that cooperate with laminar jets in the presence of a human body to produce therapeutic flows that are not blocked by the body and that exhibit delayed, controlled turbulence. The present invention meets one or more of these needs.

After much experimentation and the application of computational fluid dynamics, we have discovered how to design a laminar jet and how to introduce and maintain a laminar flow over or around specified features for a relatively long distance in a hydrotherapy bath. Desirable flow effects result when one or more convergence zones are created using surface features within the tub and directing two or more rotatable jet bodies in such a way that the water flow paths converge.

BRIEF SUMMARY OF THE INVENTION

The primary aspect of the invention is a whirlpool bath system having a one or more rotatable jet bodies designed in conjunction with optional tub surface features (channels, ribs, cavities, recesses, etc.) that at least do not inhibit laminar flow and may provide or enhance a laminar flow path that continues for a longer distance than in conventional whirlpool bath systems.

The jet bodies are designed to deliver a laminar current of water without turbulence or with minimal turbulence and/or substantially parallel streamlines in a selectable direction, instead of the standard cone shaped (conical) nozzles found on most whirlpools tub systems.

The invention is also directed to a method of designing a jet nozzle using computational fluid dynamic to maximize laminar stability and to further increase the distance the laminar flow can travel before it reaches non-stall, stall, or turbulent characteristics.

In another aspect of the invention, convergent zones are designed to bring multiple laminar flow paths together to create a result that is dynamic and soothing and to simulate flow phenomena found in naturally occurring water systems, such as rivers and water falls. These convergent zones may result in a specifically distributed water flow path in and around the most common stress areas of human anatomy, for example the shoulders, lower back, and the like.

DETAILED DESCRIPTION OF THE INVENTION

Figure 2:
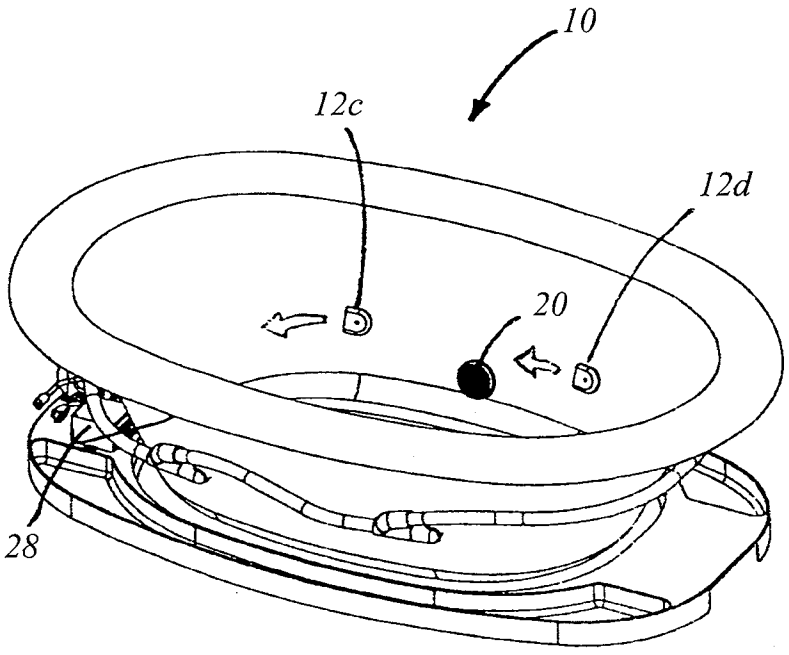
FIG. 2. Perspective view from the opposite side of the embodiment of FIG. 1.
Figure 1:
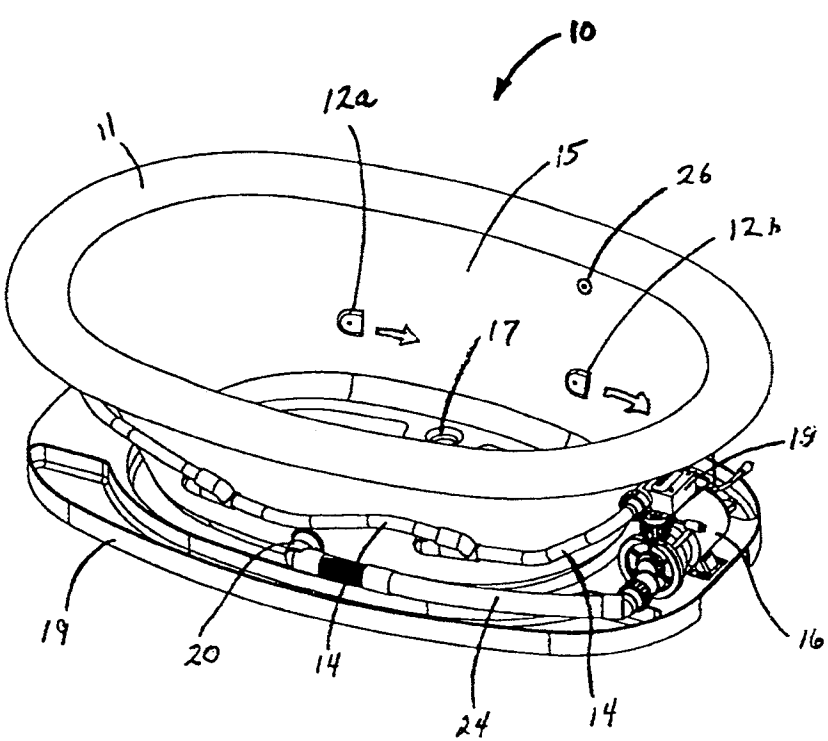
FIG. 1. Perspective view from one side of a hydrotherapy bath system according to an embodiment of the invention.
Figure 3:
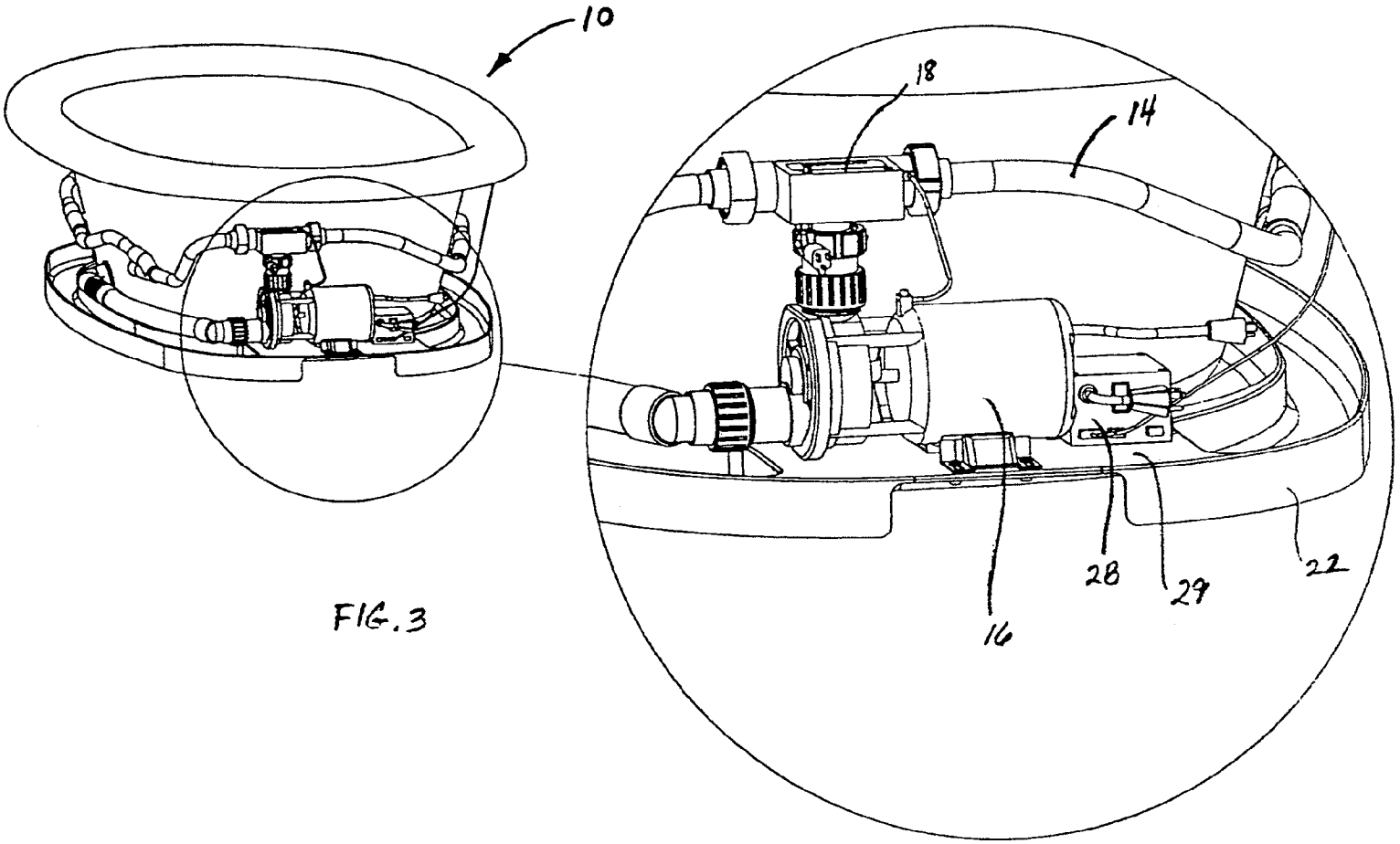
FIG. 3. Detail view of one end of the embodiment of FIG. 1.

FIGS. 1, 2, and 3 illustrate hydrotherapy tub system 10 embodiment of the invention in which four laminar jets 12*a*, 12*b*, 12*c*, and 12*d* are mounted, two on each side wall 15 of tub 11. Tub system 10 includes a water circulation system comprising pump 16, optional water heater 18, water supply tubes 14 which conduct water to the jets, suction fitting 20 attached to return tube 24. The tub system 10 has an optional on/off/speed control switch 26 and associated motor controller 28. The tub has drain hole 17 in the bottom. The embodiment shown includes an optional wide base 19 having features such as mounting plate 29 for motor 16 and controller 28, and flange 22 for mounting decorative walls or outer tub housing, catching water, or other purposes. The tub system shown is illustrative of a useful shape and set of features for a tub system. It should be recognized that other shapes and features may be utilized. The tub may be round, square, rectangular, or irregularly shaped, for example. The tub system may include more or less control of variables such as water temperature, flow rate, level, and the like. The tub system may include lighting effects, sound systems; filtration, cleaning, and/or purification systems; bath additive injection systems; check valves, blowout systems, and the like. The tub may have optional features such as headrests, textured bottom, seats, armrests, faucets, controls, and the like. The tub may be designed for one or more occupants. The plumbing may be routed differently from the illustration of FIG. 1-3. The tubing may be sloped to allow substantially complete drainage of water from the system without need for additional blowout provisions. The tub system may be a spa system. The tub may have one or more jets 12.

Referring to the embodiment of FIG. 1-3, in operation, pump 16 draws water from the tub through suction fitting 20 and return tube 24. The water is forced out of the pump through optional heater 18 into supply tubes 14. The water enters tub 11 through jets 12 and may flow in the direction indicated by the hollow arrows, towards one end of the tub, in this case at the end near the mounting location of the pump. Two or more streams of water from two or more jets may then converge at one end of the tub. The jets are adapted to minimize turbulence in the water streams so that the streams travel relatively far along the side walls and converge with relatively high force. A region in the tub where water streams converge is called a convergent zone. An occupant sitting or reclining in a convergent zone experiences a flow pattern unlike conventional turbulent whirlpool systems. A flow pattern produced by this embodiment of the invention may simulate the natural flow of a river or stream in that it is streamlined or laminar in general, but breaking into turbulence as it flows over various obstructions such as the shoulders or other body parts of the occupant. The flow pattern in the convergent zone is capable of providing a levitation effect wherein an occupant's body may be lifted by the flow and suspended in the water of the tub. Note that a multi-speed pump motor permits the occupant to alter the fluid volume leaving the jet, thus varying the effects felt in a convergent zone.

An advantage of using water alone, without the entrained air common in the art, is the improved retention of heat and consistency of water temperature. Thus the optional heater may be omitted, resulting in less flow resistance from the piping and water supply system, and a stronger effect in the tub or the same effect with less pump power. The simplicity of the piping for the water supply system allows for insulation to be easily added, resulting in a very quiet system and even less heat loss to the surroundings. Insulation such as a urethane foam or a fiberglass bat or the like may be used.

Another option that provides a unique, desirable effect is a periodically varying flow from one or more laminar jets. If two laminar jets are supplied out of phase by a periodically varying water supply, a convergent zone can be made to move gently from side to side, or more vigorously if desired. Thus, a wave effect may be imposed on the laminar flow effect through suitable programming of the water supply to the laminar jets.

Figure 1A:
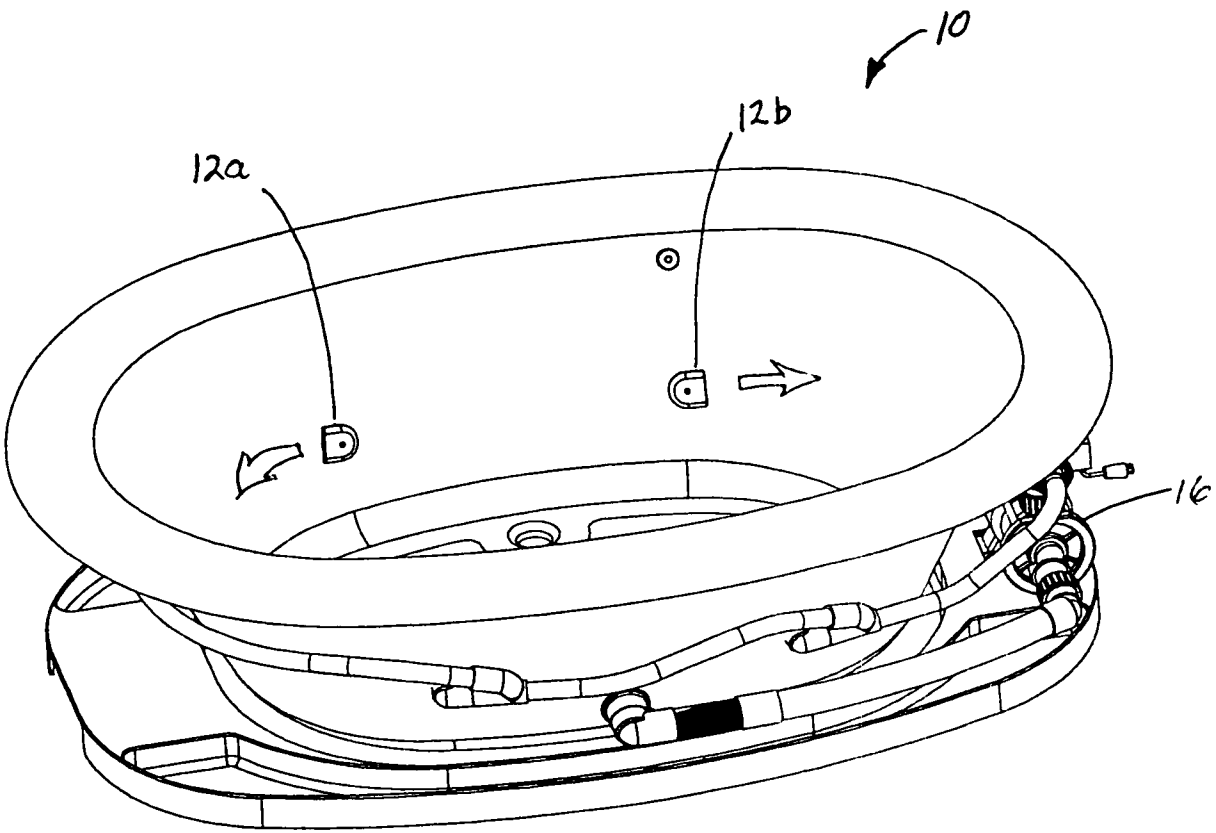
FIG. 1A. Perspective view of the embodiment of FIG. 1 with a different jet arrangement.

In the jet configuration of FIG. 1, all four jets are positioned to direct a laminar water stream toward a single convergent zone at one end of the tub. However, the jets may be rotatable, so that they may be redirected to provide alternate flow patterns. For example, referring to FIG. 1A, the two jets 12*a* and 12*d* (not shown) farthest from the convergent zone at one end of the tub may be rotated by about 180 degrees so that they direct their laminar streams toward a new, second convergent zone at the opposite end of the tub. Thus two occupants may each enjoy a convergent zone at their respective ends of the tub. By installing additional laminar jets, multiple convergent zones may be created for multiple occupants and/or for bathing multiple body parts of individual occupants with laminar flows. However, one advantage of the invention is that relatively few jets are needed because of the relatively high volumetric flow rate of each jet and the relatively great distance over which the flow can be felt. Conventional turbulent jets, typically directed at a body part, are blocked by and only felt by that body part, requiring a multitude of jets when extended effects are desired. A single inventive laminar jet may produce a flow felt throughout a tub. At least two jets are needed to provide a convergent zone.

Another flow pattern may be generated by the same four jets by directing all four jets the same direction, i.e., either clockwise or counterclockwise, thus generating a whirlpool flow pattern.

Figure 4C:
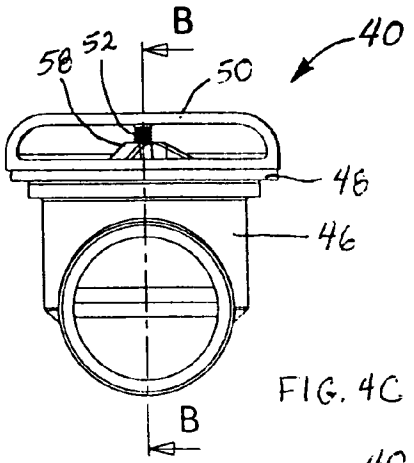
FIG. 4C. Front view of the laminar jet of FIG. 4A.
Figure 4B:
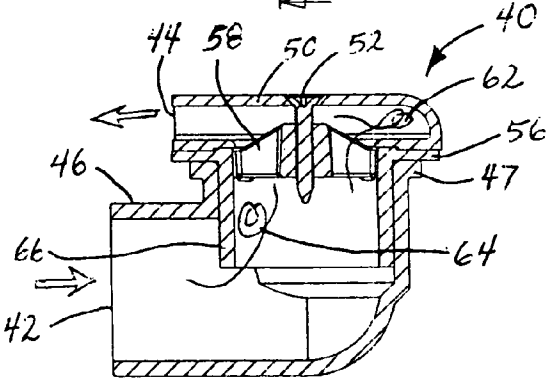
FIG. 4B. Sectional side view of the laminar jet of FIG. 4C through plane B.
Figure 4A:
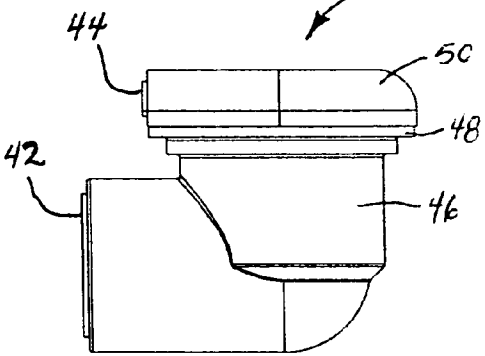
FIG. 4A. Side view of a laminar jet according to an embodiment of the invention.
Figure 5:
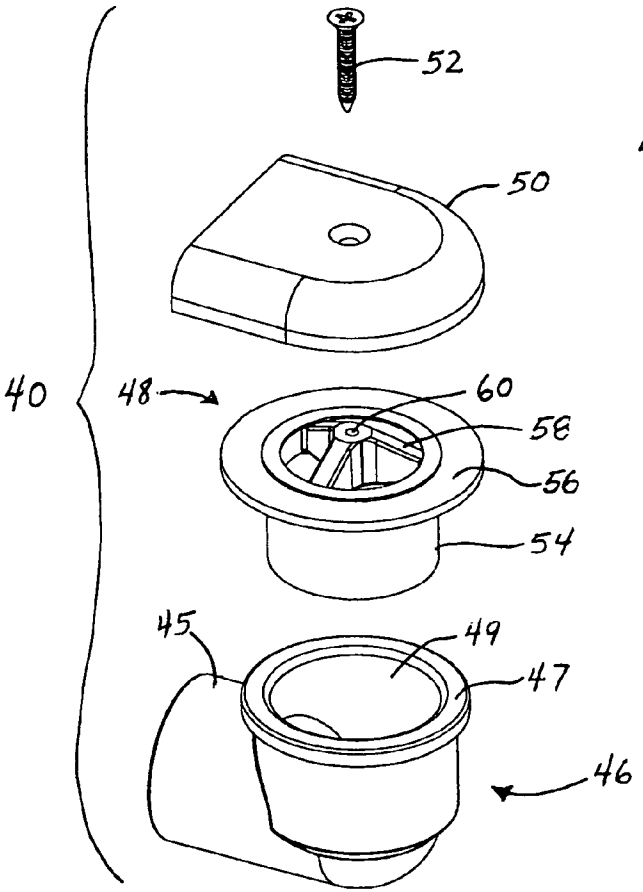
FIG. 5. Exploded perspective view of the laminar jet assembly of FIG. 4A.

FIG. 4B is a sectional view of laminar jet body 40 according to an embodiment of the invention, FIG. 4A a side view, FIG. 4C a front view, and FIG. 5 an exploded view of the same jet body 40. Referring to FIG. 4-5, flow inducer 48 has flange 56 for mounting on an inside surface of a tub and with nipple 54 adapted to extend through a hole in a tub wall. Nipple 54 may be, for example, externally threaded. The flow inducer may be molded, injection molded, cast, or machined of any suitable material. Ninety-degree elbow 46 with flange 47 is adapted, for example with internal threads at 49, to receive mating nipple 54 of flow inducer 48 and seal against the outside of the tub. The outside of the tub may be machined smooth in the vicinity of the hole if necessary and/or provided with an o-ring to improve the seal. One suitable fastening method is to thread nipple 54 into the elbow at 49 with suitable adhesive and provide an exterior o-ring between flange 47 and the machined outside surface of the tub.

Inlet 45 of elbow 46 may be of a standard nominal pipe size (for example, one inch) to facilitate attachment to standard fluid supply piping. The elbow shown is a 90° elbow to facilitate mounting of the jet and its associated piping/tubing in the typically narrow space between the tub inner wall and any outer wall present. Otherwise, no particular angle is necessary, as long as the flow path shape is optimized to minimize turbulence (as will be discussed later). The elbow shown is smooth as may be used with plastic piping, but it could also be threaded for threaded pipe fittings, compression fittings or the like, or it could be barbed for attaching hose. Laminar jet cap 50 is mounted on flow inducer 48 with an undercut flat head screw 52. Thus, cap 50 can be rotated and tightened to reside in any desired position, thus providing directional control of the flow. Flow inducer 48 illustrated includes three vanes 58 which provide both an attachment means 60 for cap 50 and screw 52, and flow stabilization and/or redirection. Alternate designs may use a different number of vanes, or may not require any vanes or any screw, as will be illustrated below.

In use, jet body 40 is connected to a fluid supply so that fluid enters elbow 46 at inlet plane 42 from outside the tub. The fluid proceeds through the elbow and into flow inducer 48. The fluid is then turned by cap 50 and ejected into the tub substantially parallel to the tub wall on which the jet body is mounted. Jet embodiment 40 represents a rather simple, but functional design which is capable of producing a desired laminar flow effect in spite of some flow imperfections. Jet body 40 has certain regions where turbulent eddies are likely to arise in use. One such region is near the rear of the cap at region 62, and another is at region 64 just around the first sharp bend created by obstruction 66. These turbulent regions can be eliminated as will be discussed below, producing more efficient jets and farther-reaching laminar currents in the tub. Nevertheless, it has been discovered that even two relatively simple or inefficient jets having a significant degree of internal turbulence, if mounted an appropriate distance apart and directed towards a convergent zone, can produce a soothing, river-like flow as described above.

In a four jet system, it may be advantageous to provide two pumps to maximize the flow rates and minimize piping losses and provide stronger laminar flow effects in the tub as well as provide more control over the flow effects.

Figure 6A:
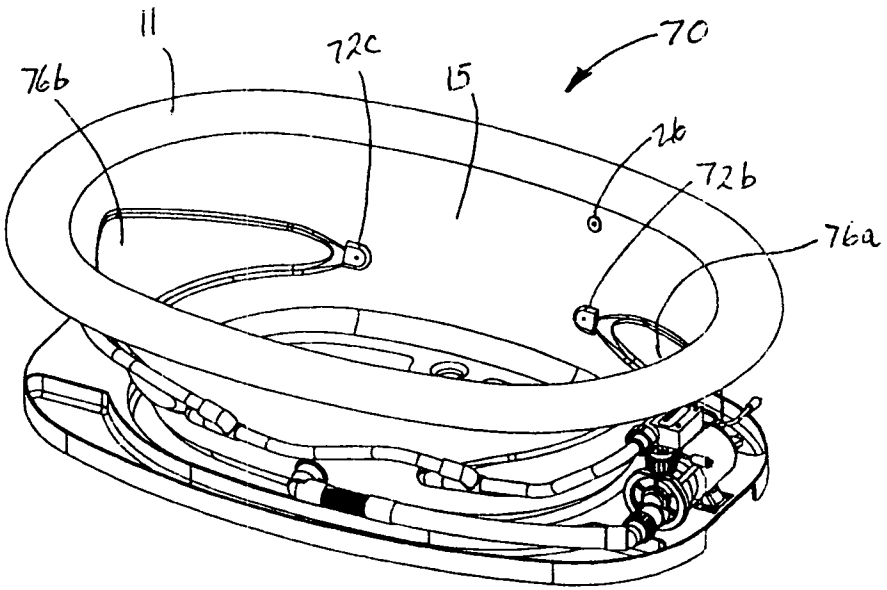
FIG. 6A. Perspective side view of an oval bathtub according to the embodiment of FIG. 6.
Figure 6:
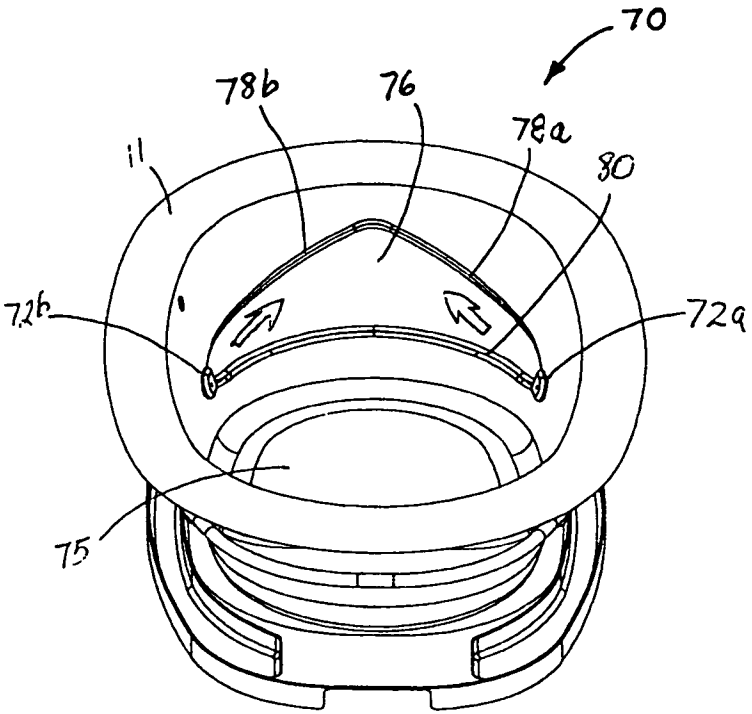
FIG. 6. Perspective end view of an oval bathtub according to an embodiment of the invention.

FIG. 6 illustrates tub embodiment 70 of the invention in which two laminar jets 72*a* and 72*b* are mounted on opposite sides near an end wall of the tub. Tub 70 has two optional headrests 74, textured bottom 75, and may optionally have other features such as seats, armrests, faucets, controls, etc. An important inventive feature of the tub is recessed, somewhat triangular, flow channel area 78 having a laminar jet 72*a* and 72*b* mounted in each of two extreme acute-angled corners. The triangular shape is defined by sides 78*a* and 78*b* and base 80. Flow channel 78 is shaped and adapted to guide each laminar water stream emitted by each of the two laminar jets to a convergent zone located centrally between the two extreme ends. The hollow arrows indicate the direction of flow of the two water streams toward the convergent the zone. Channel side 78 thus diverges from base 80, from the narrow acute-angled corner to the widest part in central convergent zone 76, in a shape that simulates the natural divergence of a laminar surface jet in a large body of fluid. The jets and channel and convergent zone thus cooperate to minimize turbulence in the water streams and maximize the distance the streams will travel across the tub surface in a laminar, boundary layer flow. The natural tendency of such a flow is to transition from laminar to pre-stall to stall, then finally to turbulence. The design of this tub effectively delays such transitions in order to create the desired laminar flow effects. It may be understood that, being adapted for two occupants, this tub 70 has an identical set of two laminar jets at the other end of the tub not visible due to the perspective of FIG. 6, but evident from the view of the same embodiment in FIG. 6A. The second set of laminar jets, including jet 72*c*, are directed to converge in a second convergent zone 76*b* identical to the first one 76, 76*a*. While this tub is designed for two occupants, it may instead be designed for just one or for more than two occupants by altering the number and positions of the recesses, the convergent zones, and the laminar jets.

Other shapes of flow channels are also possible and useful depending on the flow effects desired. A parallel or less-diverging or non-diverging channel may be used to reduce the spreading of the laminar stream from the jet, thus extending the distance the stream travels. Ribs instead of recesses may be used. Protrusions of various types may be used to redirect or influence the laminar flow, for example toward the central part of the tub, away from the wall. The flow channels may be relatively deep, allowing flexible placement of conventional jets in addition to the inventive laminar jets. Thus, the flow channels not only enhance the laminar flow effects, but may also provide for improved manufacturing and design flexibility.

When a human body is situated in the tub, with the back/shoulders near or up against the convergent zone, the body and flow may interact or cooperate to produce an effect similar to sitting, reclining or laying in a natural stream or river, with a uniform current of water flowing about the body and possibly breaking into turbulence just downstream of the body. More importantly, the recessed flow channels permit the laminar flow to continue behind the occupant's back with great strength in spite of the presence of the occupant's body instead of being blocked by the body.

Other configurations are of course possible. The laminar jets may be rotated or repositioned as desired to vary the location or nature of the convergent zone or zones in the tub and produce various corresponding effects. The jets may be directed at the legs, feet, arms, lower back, or other body portion instead of the back and shoulders. For example, the jets may be directed to converge under the thighs or buttocks of the occupant, providing a lifting or levitation effect on the entire body.

Additional jets may be used for producing multiple effects. For example, conventional air jets or orifices may be used in the bottom of the tub to superpose bubble flows on the laminar converging flow or in other parts of the tub. Alternatively, conventional air, water, or air/water jets may be installed in a way that provides full control over which, if any, jets are used at any particular time. A convergent zone may be created by any two or more jets arranged to produce a desired convergent flow pattern or effect on an occupant in a tub.

Figure 7:
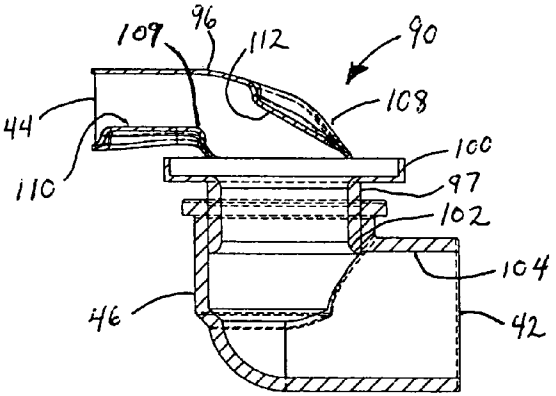
FIG. 7. Sectional view of a laminar jet according to another embodiment of the invention through plane C of FIG. 8.

FIG. 7 illustrates another embodiment of a laminar jet body 90 having a specially tailored internal channel shape. The internal channel shape of FIG. 7 was designed using computational fluid dynamics (CFD) with the goal of minimizing turbulence both within the jet body 90 and after the fluid jet leaves the jet body at exit plane 44. The resulting internal channel shape is strongly suggestive of flow streamlines or natural streamline flow. The internal channel is designed to eliminate or inhibit turbulence by minimizing any structural feature that may produce a disturbance to natural streamline flow through the jet body. In addition, the design strategy includes three computational steps. Mathematically, the pressure field is calculated for a three dimensional model of the jet body from the Navier-Stokes equations using a commercial CFD software package. With the inlet plane representing zero pressure the design geometry is adjusted to minimize internal regions of negative pressure and totally eliminate negative pressure anywhere on the outlet plane. At the same time, the volumetric flow rate is calculated, and design changes are sought which maximize the flow rate. The third computation utilized is to calculate and display the flow paths or streamlines in order to make geometrical changes which eliminate eddies or non-laminar flow regions. The computation is applied to a jet model in a U-configuration as shown in FIGS.

Figure 8A:
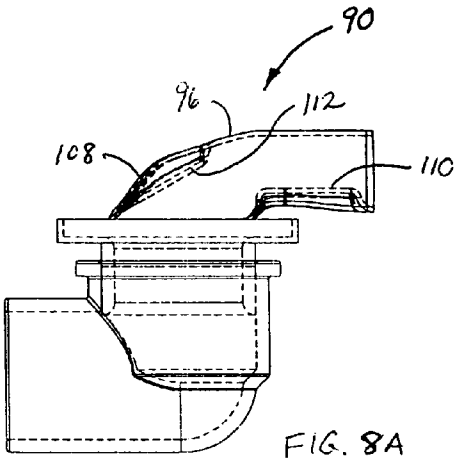
FIG. 8A. Side view of the laminar jet of FIG. 7.
Figure 8B:
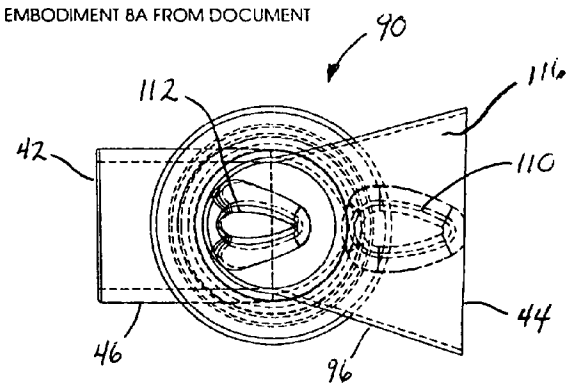
FIG. 8B. Top view of the laminar jet of FIG. 7.
Figure 8:
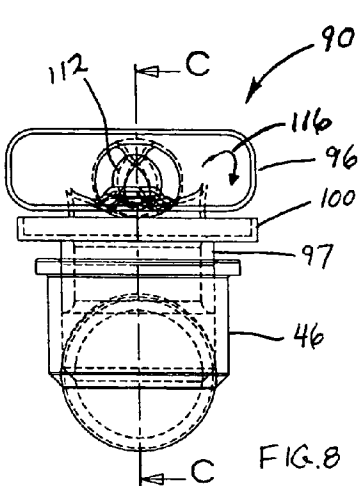
FIG. 8. Front view of the laminar jet of FIG. 7.

4 and 9 and repeated for a jet model in an S-configuration as shown for example in FIGS. 7 and 8. Thus the jet is optimized for use in various positions which may be chosen by the tub user. These steps may be repeated as needed or until the desired level of performance is attained for the model in as many positions as desired, as indicated by the CFD results, i.e., the pressure field, volumetric flow rate, and streamline pattern. When this design approach is applied, it is found that the resulting fluid jet can have excellent laminar flow stability for much longer distances upon entering the tub than conventional whirlpool jets. The resulting effect in the tub, especially in conjunction with the flow channels described above may simulate that of a natural laminar current, and the sensation on a human body is quite different from that of conventional turbulent whirlpool designs. Moreover, the intended flow effects may be not inhibited or blocked by the presence of a human body.

The design method was first applied by subjecting a model of the jet embodiment 40 of FIG. 5 to CFD analysis. The CFD results showed regions of both positive and negative pressure, as well as localized turbulence areas. The highest negative pressure was at exit plane 44 of jet 40. The negative pressure at the exit will induce a turbulent flow as it exits the jet, reducing the distance the stream can travel along a tub wall boundary or in a laminar fashion prior to reaching a convergent zone. Then design method was then applied to improve the laminar jet performance of jet 40.

The jet body 90 of FIGS. 7, 8, 8A, and 8B illustrates a second laminar jet embodiment that has cap 96, flow inducer 97, and elbow 46. The cap 96 and flow inducer 97 have alternate means of attachment thus eliminating the structural need for a screw or vane in the embodiment of FIG. 4. The attachment means may be for example threads with lock nut, snap fit, or other mechanical fasteners. Thus, the jet may be fully, 360 degrees, rotatable and fixable. Alternately, the cap and flow inducer attachment means may provide for limited rotation, for example to prevent the jet from being oriented vertically and spraying water out of the tub. A 270-degree rotation is advantageous in that it allows the jet to be positioned about 45 degrees about horizontal which provides a stream well suited to flowing up the back and over the shoulders. In such a flow, it may be also advantageous to provide a higher tub side wall, for example in the form of a head rest or raised back rest to assure containment of the upward directed streams. Attachment means may also include positive stops for quick and easy orientation or positioning in certain preferred directions. Flow inducer 97 may have threaded nipple 102 for mounting in elbow 46, which is the same in shape and function as elbow 46 in FIG. 4. The various optional attachment means may also be applied to the other embodiments discussed.

Instead of relying on vanes to reduce turbulence, jet body 90 is streamlined to a much greater degree than jet body 40. The internal shape and features directly result from applying the design method described above, but with a limited number of iterations and design changes. The design changes discussed are relative to the starting CFD model based on jet body 40 of FIG. 4. Flow inducer 97 has shortened nipple 102 which does not extend into the elbow beyond upper inner wall 104. Also, the nipple has a rounded inside edge at 102. These two changes from the design of FIG. 4 serve to reduce or eliminate the turbulent eddy observed in jet body 40 at 62. Jet cap 96 is also severely tapered, shortened, or rounded at the back of the cap at 108, thus greatly reducing the turbulent eddy observed in jet body 40 at 62. The cap diverges from the flow inducer to exit plane 44, as easily seen in the top view of FIG. 8B. The divergence of the cap 96 helps eliminate negative pressure at exit plane 44. Finally, jet body 90 has within cap 96 a smooth, rounded protrusion or restriction 110 and second smooth protrusion 112. These two protrusions help the fluid to accelerate out of the vertical portion of the flow inducer and move more fluid toward the edges of the diverging cap, thus preventing edge eddies and negative pressure areas for example at 116 in FIGS. 8 and 8B. The resulting flow streamlines show a downward component, indicated by the arrow at 116 in FIG. 8, which helps the laminar stream to flow close to the tub wall upon leaving jet exit plane 44. Computational fluid mechanics showed that this design results in no net pressure loss at exit plane 44, relative to entrance plane 42, and only a little turbulent eddy at the back of the cap near 108, and some non-parallel streamlines due to relatively sharp corner 109. At exit plane 44, the fluid velocity is about the same as at entrance plane 42. Thus, this jet has very nearly laminar flow throughout and is much more efficient that the jet of FIG. 4.

FIGS. 9, 9A, 10, 10A-D, and 11 show another embodiment in laminar jet body 120 having further-refined, streamlined internal features for producing highly laminar flow within the jet body and within the tub. Jet body 120 exhibits additional refinements of the streamlined internal shape of the cap and flow inducer, but has the same elbow component 46 as the previous embodiments. The improvements in jet body 120 are the result of further application of the design method described above. The refinements include larger protrusion 122, which now reaches down very close to rounded inner edge 102 of nipple 106. Protrusion 122 transitions smoothly into final 90-degree turn 124, thus eliminating all eddies in the back of cap 126. FIGS. 10, 10A-D and 11 show various views of jet body 120, including various views of protrusion 122. Flow inducer 127 now has a larger radius at 136, which matches a larger radius in neck 134 of cap 126, which provides a smoother flow transition from the vertical section into the cap and on to the exit plane. Cap 126 has a divergent shape, shown clearly in the top view of FIG. 10, which is much more streamlined than the straight-edged cap of FIG. 8B. The bottom, side edges of cap 126 are chamfered at 132 to improve the pressure distribution and streamline distribution at exit plane 44. This embodiment produces highly laminar flow within jet body 120 and injects a highly laminar stream into the tub, along the side of the tub, thus producing the desired laminar affects in the converging zone of a tub embodiment as discussed above. Computational fluid dynamics shows that jet body 120 has no turbulent eddies, and has no pressure drop from inlet plane 42 to outlet plane 44.

Figures 10, 10A, 10B, 10C, 10D, 11:
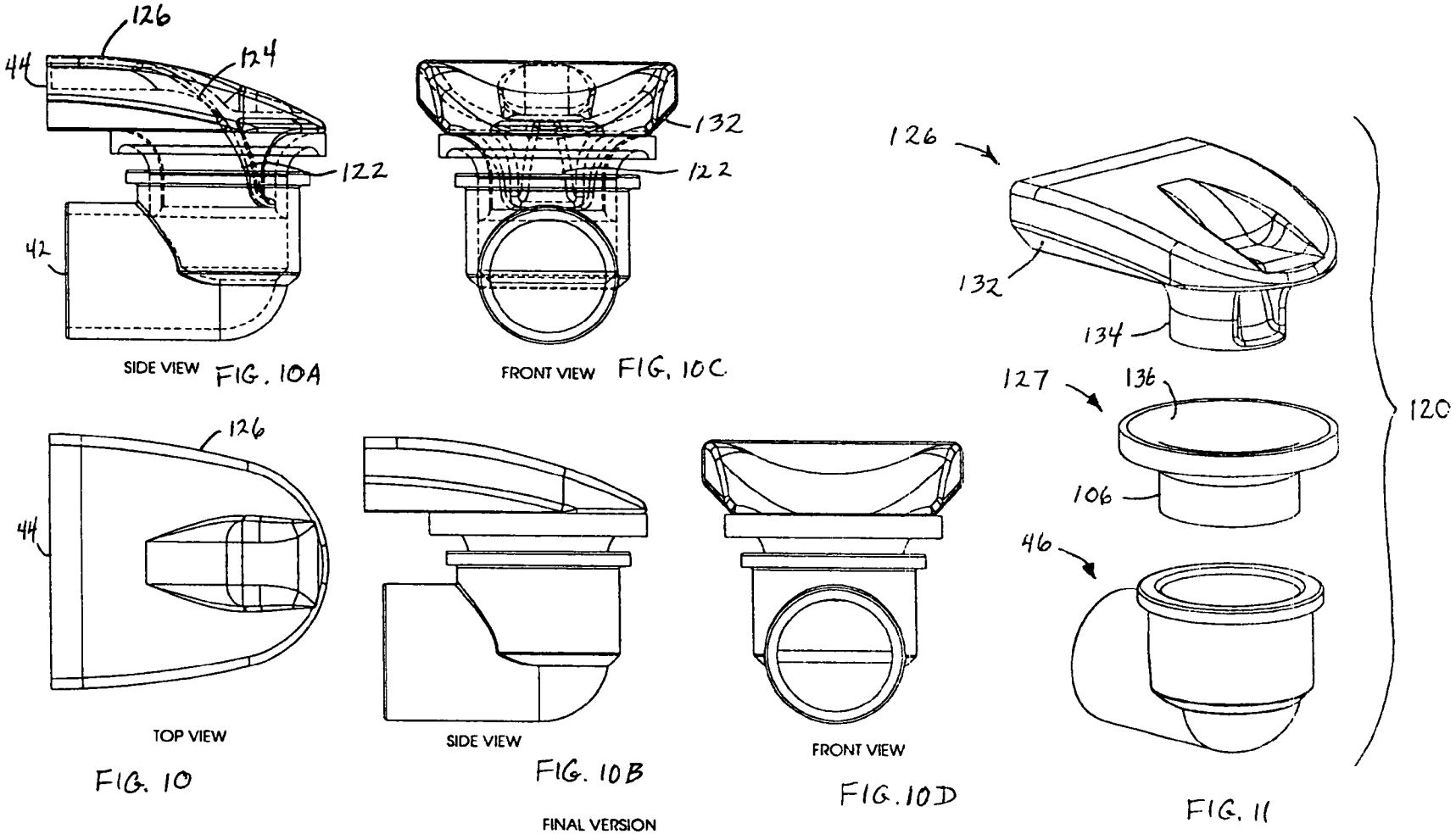
FIG. 10. Top view of the laminar jet of FIG. 9.
FIG. 10A. Side view of the laminar jet of FIG. 9.
FIG. 10B. Side view of the laminar jet of FIG. 9.
FIG. 10C. Front view of the laminar jet of FIG. 9.
FIG. 10D. Front view of the laminar jet of FIG. 9.
FIG. 11. Exploded perspective view of the laminar jet assembly of FIG. 9.

As shown in FIG. 11, jet body 120 is assembled from three component parts. As in other embodiments described above, flow inducer 127 and elbow 46 are fastened together permanently through a hole in a tub wall by means of threads, adhesive, or the like, optionally with o-ring, gasket, or the like on one or both sides. Cap 126 is then rotatably mounted on flow inducer 127 by means of fasteners, snap-lock or snap-fit features, lock rings, or the like.

Figure 9A:
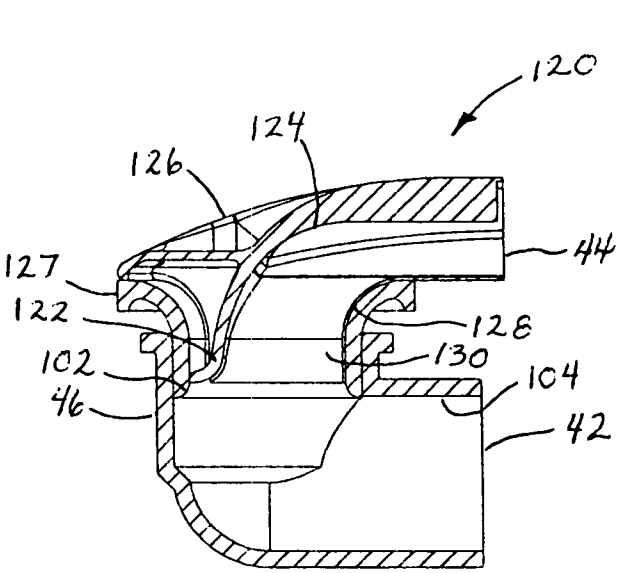
FIG. 9A. Sectional view of the embodiment of FIG. 9 through plane A.
Figure 9:
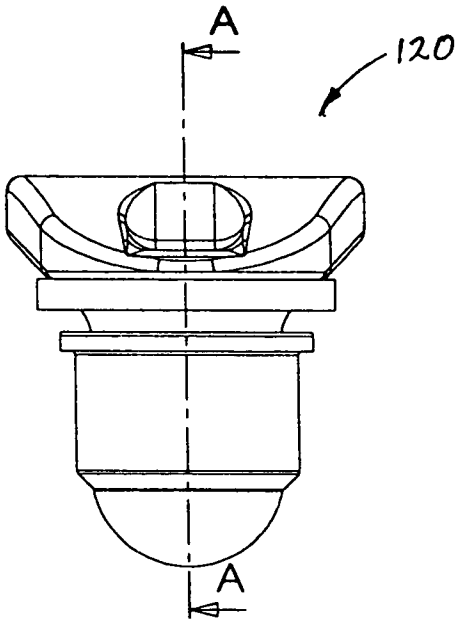
FIG. 9. Back view of a laminar jet according to another embodiment of the invention.

There is a zone of negative pressure at the front of the vertical portion of jet body 120 at reference numeral 130 in FIG. 9A. In another embodiment, zone 130 can be utilized to draw in air according to the venturi effect, or by forced injection, through an optional air inlet, not shown. Introducing air at such an optional air inlet would tend to increase turbulence in the flow stream in the tub, to reduce water volumetric flow rate, and to shorten the distance the jet would propagate in a laminar stream flow. Nevertheless, the introduction of air may provide a desirable, optional hydrotherapy effect for the bathtub occupant.

The present invention also relates to a new method of producing a desirable laminar flow effect in a hydrotherapy tub. The method includes the steps of installing, in a hydrotherapy tub with a water circulation system, two or more laminar jets, each jet capable of producing a substantially laminar water stream in a desired flow direction substantially parallel to a tub surface; rotating and fixing the position of the jets so that the respective water streams are directed toward a convergent zone. The jets are preferably selected to have an internally streamlined profile. The jets may be further selected to have no pressure drop from inlet plane to exit plane. The jets may be further selected to have no turbulent eddies at the flow rates to which they are subjected. The jets may be fully rotatable, 360 degrees about an axis perpendicular to a tub surface, and have means for locking them in position. The jets may be partially rotatable with stops to prevent vertical discharge of water and/or stops for certain preferred positions. The convergent zone may be described by a recessed flow channel in the wall of the tub. The convergent zone may have various shapes, such as parallel sides, triangular or diverging sides, or the like.

Although forms of the invention have been described herein, it will be evident to those skilled in the art that variations may be made in the construction and relation of parts without departing from the spirit and scope of the invention described herein. The invention disclosed herein may suitably be practiced in the absence of any element that is not specifically disclosed herein.

What is claimed is:

1. A laminar jet for mounting on a wall of a hydrotherapy tub comprising:

a water inlet adapted for attachment to a water circulation system;

a flow inducer section attachable to the water inlet;

a cap attached to the flow inducer section; and a water outlet at one end of the cap;

wherein the cap is rotatable by a tub user about an axis perpendicular to the wall of the tub; and wherein the jet is adapted to direct a substantially laminar water stream from the water outlet substantially parallel to an inside surface of the wall of the tub.

2. The laminar jet of claim 1 wherein the cap is lockable in a desired position.

3. The laminar jet of claim 1 wherein the cap is rotatable alone or in rigid connection with the flow inducer section and is lockable in a desired position.

4. The laminar jet of claim 1 wherein the jet is adapted for mounting on or through a wall of the tub; and wherein the cap is rotatably attached to the flow inducer section and is lockable in a desired position.

5. The laminar jet of claim 1 wherein the internal profile of the flow inducer section and cap are streamlined to minimize turbulent eddies within the jet.

6. The laminar jet of claim 1 wherein the pressure change from the water inlet to the water outlet is non-negative.

7. The laminar jet of claim 1, wherein the internal fluid dynamics of the jet allow the fluid to exit at an equal to or greater pressure than the initial entrance pressure, thus presenting the same volume of water through the jet body.

8. The laminar jet of claim 1, wherein the laminar flow is optimized to minimize turbulent eddies, and wherein fluid velocity is maximized at the jet outlet face.

9. The laminar jet of claim 1, wherein the laminar flow is optimized to minimize turbulent eddies, and wherein fluid velocity is maximized at the jet outlet face, at least partly by means of suitable smooth protrusions within the jet.

10. A bathtub comprising an inner tub surface; a number consisting of one or more laminar jets rotatably mounted on the inner tub surface; and a water circulation system for circulating water from the tub vessel to the laminar jets;

wherein the jets are each capable of directing a water stream substantially parallel to the inner tub surface.

11. The bathtub of claim 10 wherein said number of jets comprises one.

12. The bathtub of claim 10 wherein said number of jets comprises two or more and wherein said two or more jets are positionable to aim at a convergent zone.

13. The bathtub of claim 10 wherein at least one of said laminar jets is associated with a divergent, recessed, flow channel located in or on the inner tub surface; wherein said channel diverges from a narrow part near said at least one laminar jet toward a wider part near a convergent zone.

14. The bathtub of claim 12 wherein at least two of said two or more laminar jets are associated with divergent recessed channels located in or on the inner tub surface; wherein each said channel diverges from a narrow part near one of said laminar jets toward a wider part near a convergent zone.

15. The bathtub of claim 12 further comprising one or more recessed flow channels on said surface; wherein at least two of said jets are positionable to each direct a water stream along said channels; and wherein at least two said streams converge in a convergent zone.

16. The bathtub of claim 12 wherein two jets associated with two divergent recessed, smooth, or protruded surface features are directed toward the convergent zone.

17. The bathtub of claim 10 wherein each laminar jet has an internal channel shape, and the internal channel shape is tailored to inhibit disturbances to natural streamline flow through the jet and maximize the distance the fluid will travel before a turbulent transition occurs.

18. The laminar jet of claim 5 wherein said laminar water stream is turned by said cap from a direction induced by said flow inducer section to a direction substantially parallel to the surface of the tub.

19. The laminar jet of claim 18 wherein said cap is rounded internally at the back thereof to turn said water stream and prevent turbulent eddies at the back of the cap.

20. The laminar jet of claim 19 wherein said cap has a smooth, rounded protrusion at the rounded back thereof.

21. The laminar jet of claim 18 wherein said cap has an internal channel shape that diverges from the back of the cap to the outlet.

* * * * *